US011772142B2

(12) United States Patent
Fujita et al.

(10) Patent No.: US 11,772,142 B2
(45) Date of Patent: Oct. 3, 2023

(54) ROLLING METHOD, PRODUCTION METHOD FOR METAL SHEET, AND ROLLING DEVICE

(71) Applicant: JFE Steel Corporation, Tokyo (JP)

(72) Inventors: Noriki Fujita, Tokyo (JP); Yukihiro Matsubara, Tokyo (JP); Yu Nagai, Tokyo (JP); Yoshimitsu Harada, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 72 days.

(21) Appl. No.: 17/629,190

(22) PCT Filed: Feb. 10, 2020

(86) PCT No.: PCT/JP2020/005121
§ 371 (c)(1),
(2) Date: Jan. 21, 2022

(87) PCT Pub. No.: WO2021/014665
PCT Pub. Date: Jan. 28, 2021

(65) Prior Publication Data

US 2022/0250129 A1 Aug. 11, 2022

(30) Foreign Application Priority Data

Jul. 23, 2019 (JP) ..... 2019-135593

(51) Int. Cl.
*B21B 27/10* (2006.01)
*B21B 45/02* (2006.01)
*B21B 1/28* (2006.01)

(52) U.S. Cl.
CPC ..... *B21B 45/0257* (2013.01); *B21B 1/28* (2013.01); *B21B 27/10* (2013.01)

(58) Field of Classification Search
CPC ..... B21B 45/0239; B21B 45/0245; B21B 45/0251; B21B 45/0296; B21B 27/10;
(Continued)

(56) References Cited

U.S. PATENT DOCUMENTS 6,497,127 B2 * 12/2002 Nishiura ..... B21B 45/0251 72/236

FOREIGN PATENT DOCUMENTS

JP 2006-263772 A 10/2006
JP 2007-144514 A 6/2007
(Continued)

OTHER PUBLICATIONS

CN 107520253A, Bai et al. Dec. 2017.*
(Continued)

*Primary Examiner* — Edward T Tolan
(74) *Attorney, Agent, or Firm* — DLA Piper LLP (US)

(57) ABSTRACT

A rolling oil supply system is configured to supply rolling oil to a rolling stand selected from a plurality of rolling stands included in a tandem rolling mill, a first rolling oil supply system configured to circulate and supply rolling oil after removing wear powder generated by rolling, and a second rolling oil supply system configured to supply rolling oil containing the wear powder generated by rolling are provided. Mixed rolling oil in which the rolling oil supplied from the first rolling oil supply system and the rolling oil supplied from the second rolling oil supply system are mixed is supplied to selected fourth and fifth rolling stands.

18 Claims, 3 Drawing Sheets

(58) Field of Classification Search
CPC . B21B 45/0257; B21B 45/029; F16N 31/004; F01M 2001/071
See application file for complete search history.

(56) References Cited

FOREIGN PATENT DOCUMENTS

| | | | |
|---|---|---|---|
| JP | 2008-006487 | A | 1/2008 |
| JP | 2009-195961 | A | 9/2009 |
| JP | 2010-221233 | A | 10/2010 |
| JP | 2013-099757 | A | 5/2013 |

OTHER PUBLICATIONS

KR 20130064385A, Kim et al. Jun. 2013.*
JP 2010-221233A, Fujita Oct. 2010.*
JP 57-79016A, Tamiya et al. May 1982.*
WO 2018/141632A1, Hervieu et al. Aug. 2018.*
JP 63-264212A, Furuno et al. Nov. 1988.*
Translation JP 63-26421A, Furuno et al. Nov. 1988.*
JP 2013-99757A Fujita May 2013.*
Extended European Search Report dated Jul. 27, 2022, of counterpart European Patent Application No. 20844560.1.
An English translation of the International Preliminary Report on Patentability and Written Opinion dated Feb. 3, 2022.

* cited by examiner

ROLLING METHOD, PRODUCTION METHOD FOR METAL SHEET, AND ROLLING DEVICE

TECHNICAL FIELD

This disclosure relates to a technology relating to tandem rolling and a production method for a metal sheet using the technology.

BACKGROUND

Rolling oil is used when a rolled material (for example, steel sheet) is cold-rolled by a rolling roll. The rolling oil plays a role as a lubricant (lubricating oil) for reducing friction generated between the steel sheet and the rolling roll during rolling. In addition, the rolling oil also has a role as a cooling agent for cooling the rolling roll and the steel sheet such that the temperatures of the rolling roll and the steel sheet do not rise excessively due to the frictional heat generation and the processing heat generation generated during rolling.

As a supply method for the rolling oil during cold rolling, a direct lubrication method (direct method) in which rolling oil is not circulated and used and a circulating lubrication method (recirculation method) in which rolling oil is circulated and used are known.

In recent years, there has been an increasing need for a thin material having a high strength and a thin gauge for the purpose of suppressing fuel consumption by reducing weight. For thin materials with a sheet thickness of 0.3 mm or less after rolling, high-speed rolling of 2000 mpm or more is aspired for improving productivity. However, when rolling oil is supplied by the circulating lubrication method in the related art during high-speed rolling, it is known that lubrication is insufficient, mill vibration called chattering occurs, and a phenomenon in which a sheet thickness fluctuates periodically is likely to occur. The higher strength the thin material has, the slower the rolling speed at which chattering occurs becomes, and the rolling speed cannot be increased, which is a factor that hinders the high productivity of high value-added products.

A hybrid lubrication method as illustrated in JP 2006-263772 A and JP 2013-99757 A is known as a means for eliminating chattering in a high-speed rolling region due to insufficient lubrication. In the hybrid lubrication method, the direct lubrication method is adopted in parallel with the circulating lubrication method.

In JP '772 and JP '757, by adjusting the supply amount of second rolling oil supplied by the direct lubrication method different from a first rolling oil supplied by the circulating lubrication method, a lubrication state on a downstream side and adjacent rolling stands is adjusted.

When we examined JP '772 and JP '757, we found that, when the supply amount of the second rolling oil is controlled to obtain a target lubrication state, a friction coefficient at the rolling stand on the downstream side to which the second rolling oil is supplied inevitably acts in a direction of being decreased. Therefore, when the friction coefficient of the adjacent rolling stand is small, it is necessary to increase the supply amount of the second rolling oil, and as a result, the friction coefficient is remarkably decreased, which causes slippage. Since chattering also occurs due to slippage, we found that the methods described in JP '772 and JP '757 may not sufficiently eliminate the occurrence of chattering.

It could therefore be helpful to provide a rolling technology capable of corresponding to high-speed rolling in tandem rolling.

SUMMARY

We examined the properties of second rolling oil for effectively suppressing chattering in high-speed rolling using the circulating lubrication method as follows.

In a tandem rolling mill, rolling oil emulsion is often used as the rolling oil. In the rolling oil emulsion circulated and used in the tandem rolling mill, wear powders ("wear powder" may be also referred to as "iron powder") generated by friction between the rolling roll and a steel sheet during rolling are accumulated over time. The wear powder mixed in the rolling oil emulsion combines with fatty acids liberated from the oil to form an iron soap, and when the wear powder and the iron soap are introduced into the roll bite (between the rolling roll and the steel sheet) together with the rolling oil emulsion, a lubricating effect is exhibited.

Since there is a concern that an agglomerate called scum is generated due to an excess of iron soap, an iron powder removing device such as a Hoffman filter is used to control the iron powder concentration in the rolling oil emulsion to be below a certain range (refer to, for example, JP 2009-195961 A).

On the other hand, when the cold rolling was performed by containing iron powder within a range where scum did not occur, we found that the iron powder not combined with fatty acids was introduced into the roll bite and came into contact with a new surface formed on the surface of the steel sheet during rolling, and thus a rolling load was increased. That is, we found that the friction coefficient changed when the amount of iron powder contained in the rolling oil emulsion significantly fluctuated.

In addition, we found that chattering can be suppressed by appropriately maintaining the balance of friction coefficients of a final rolling stand, which is the main source of chattering, and the rolling stand on the upstream side of the final rolling stand (particularly, the adjacent rolling stand). As a result, we concluded that it is useful to control the amount of iron powder in the rolling oil emulsion supplied to the rolling stand to appropriately maintain the balance of the friction coefficients of the two adjacent rolling stands.

We thus provide a rolling method that rolls a rolled material by a tandem rolling mill including a plurality of rolling stands, the method including: supplying by mixing rolling oil supplied from a first rolling oil supply system and a second rolling oil supply system to one or two or more rolling stands selected from the plurality of rolling stands, in which the first rolling oil supply system circulates and supplies rolling oil subjected to a removal treatment of wear powder generated by the rolling, and the second rolling oil supply system supplies rolling oil containing the wear powder generated by the rolling.

We also provide a rolling device including: a tandem rolling mill including a plurality of rolling stands; a first rolling oil supply system configured to circulate and supply rolling oil after a removal treatment of wear powder generated by rolling; a second rolling oil supply system configured to supply rolling oil containing the wear powder generated by rolling; and a mixing unit configured to mix the rolling oil supplied from the first rolling oil supply system and the rolling oil supplied from the second rolling oil supply system to obtain mixed rolling oil, in which the mixed rolling oil is supplied to a rolling stand selected from the plurality of rolling stands.

Chattering can be suppressed by increasing or decreasing the content of wear powder in the rolling oil supplied to the rolling stand as necessary. As a result, it is possible to provide the rolling technology capable of corresponding to high-speed rolling in tandem rolling provided with a circulating lubrication method.

REFERENCE SIGNS LIST

Figure 1:
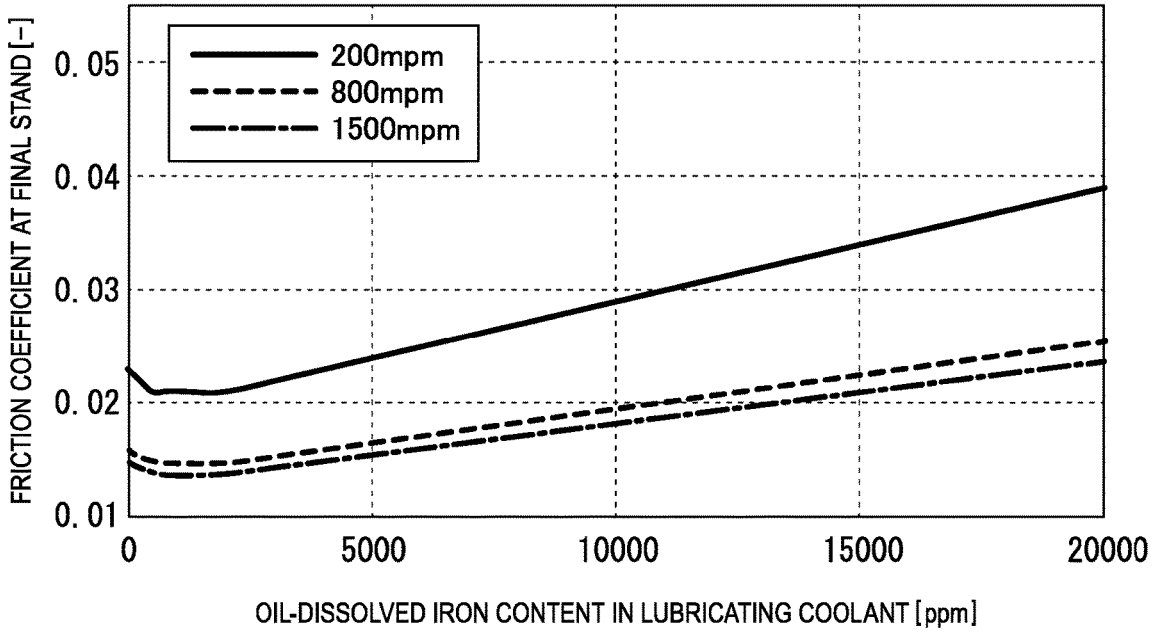
FIG. 1 is a graph describing a relationship between the amount of iron powder in rolling oil emulsion and a friction coefficient.

1 steel sheet (rolled material)
2 first rolling oil supply system
5 dirty tank (collection tank)
6 iron powder removing device
7 clean tank (storage tank)
8A, 8B pump
9 first rolling oil pipeline
10 oil pan
11 return pipe
13 first rolling oil emulsion
15 second rolling oil emulsion
16 second rolling oil pipeline
17 strainer
18 flow control valve (mixing unit)
20 supply control unit
21 first friction coefficient computing unit
22 target friction coefficient setting unit
23 mixing ratio control unit
24 second friction coefficient computing unit
25 FB computing unit
26 memory

DETAILED DESCRIPTION

Next, examples of methods and rolling devices will be described with reference to the drawings.

In the examples described below, cold rolling will be described as an example of rolling. However, this disclosure is also applicable to hot rolling.

Rolling oil may be any petroleum-based or emulsion-based rolling oil. However, in general, emulsion-based rolling oil (rolling oil emulsion) is often used as the rolling oil because the cold rolling oil for steel is required to have high cooling performance. Therefore, in the following examples, rolling oil emulsion (also referred to as "emulsion") will be described as an example of the rolling oil.

Emulsion is a mixed liquid in which rolling oil particles are stably suspended in water. Properties of emulsion are characterized by the concentration and average particle diameter. The emulsion concentration is a ratio of the oil content mass to the total mass of the emulsion. The average particle diameter is the average particle diameter of the rolling oil in the emulsion. In addition, it is necessary to add a surfactant and emulsify the oil in water to prepare the emulsion. The amount of the surfactant added is a predetermined amount indicated by the mass concentration (concentration with respect to oil) with respect to the amount of rolling oil. The average particle diameter of the emulsion is adjusted by applying shearing with a stirrer and a pump after adding the surfactant.

For example, the rolling oil emulsion is rolling oil (oil-in-water drop type rolling oil) in an O/W emulsion state where the rolling oil is diluted with warm water or the like to a concentration of approximately 1% to 5% by mass and the oil is dispersed in water using a surfactant.

We investigated a relationship between the amount of iron powder in the rolling oil emulsion and the friction coefficient at the final rolling stand in an actual tandem rolling mill including five stands. The survey results are illustrated in FIG. 1. The amount of iron powder is the oil-dissolved iron content contained in the oil in the emulsion. As is clear from FIG. 1, the friction coefficient at the final rolling stand increases as the oil-dissolved iron content increases. In addition, there is a tendency that the lower the rolling speed, the larger the friction coefficient at the final rolling stand. From this fact, it can be seen that the friction coefficient can be controlled by adjusting the amount of iron powder according to the rolling speed.

Configuration

First, cold rolling equipment and other configurations will be described.

In this example, the steel sheet 1 is taken as an example of the rolled material. The rolled material can be applied to an aluminum sheet or other metal strip.

Figure 2:
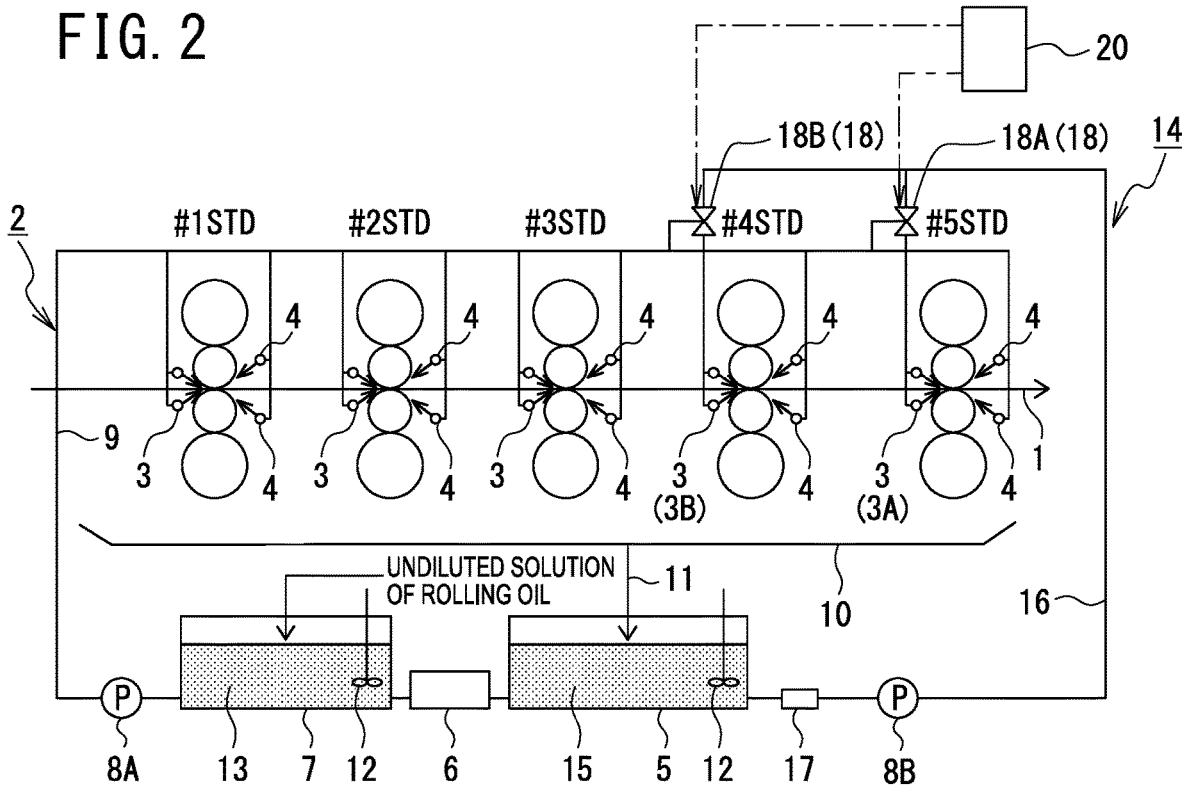
FIG. 2 is a diagram illustrating a schematic configuration of cold rolling equipment according to an example.

As illustrated in FIG. 2, a tandem rolling mill is an example of a configuration in which a rolling mill with five stands, from a first rolling stand to a fifth rolling stand (#1 STD to #5 STD) in order from an inlet side (on the left side when facing a paper surface in FIG. 2) of the steel sheet 1 (rolled material), is provided. In this cold tandem rolling mill, tension rolls and deflector rolls (not illustrated) are appropriately installed between adjacent rolling stands. The configuration of the rolling stand, a transport device for the steel sheet 1, and the like are not particularly limited, and known technology may be applied as appropriate.

An oil pan 10 is disposed below the first rolling stand to the fifth rolling stand. The rolling oil emulsion used in the cold rolling is collected in the oil pan 10, and the rolling oil emulsion collected in the oil pan 10 is returned to a dirty tank 5 (collection tank) through a return pipe 11. The returned rolling oil emulsion contains wear powder (iron powder) generated by friction between the rolling roll and the steel sheet 1. Hereinafter, the rolling oil stored in the dirty tank 5 may be referred to as a second rolling oil emulsion 15 to distinguish the rolling oil from a first rolling oil emulsion 13 stored in a clean tank 7 described later.

In addition, the example includes the clean tank 7 constituting a storage tank. The first rolling oil emulsion 13 is housed (stored) in the clean tank 7. The first rolling oil emulsion 13 is formed by mixing warm water (diluted water) and a neat oil of rolling oil (with a surfactant added). The warm water and the neat oil of rolling oil thus mixed are made into the first rolling oil emulsion 13 having a desired average particle diameter and concentration range by adjusting the rotation speed of a stirring blade of a stirrer 12, that is, by adjusting the degree of stirring.

A portion of the rolling oil emulsion supplied to the rolling mill is taken out of the system by the steel sheet 1 or lost by evaporation. Therefore, the neat oil of rolling oil is appropriately replenished (supplied) from a neat oil tank (not illustrated), such that the storage level of the first rolling oil emulsion 13 in the clean tank 7 and the concentration of the first rolling oil emulsion 13 to be supplied are within a predetermined range. In addition, warm water for dilution is appropriately replenished (supplied) to the clean tank 7. The storage level and concentration of the first rolling oil emulsion 13 in the clean tank 7 can be measured by a sensor (not illustrated).

As the rolling oil constituting the first rolling oil emulsion 13, the rolling oil used for ordinary cold rolling can be applied. That is, as the first rolling oil emulsion 13, for example, one using any one of natural fat and oil, fatty acid esters, and hydrocarbon-based synthetic lubricating oil as base oil can be used. Furthermore, additives used in ordinary cold rolling oil such as an oiliness improver, an extreme pressure additive, and an antioxidant, may be added to the rolling oil.

In addition, as the surfactant added to the rolling oil, either an ionic type or a nonionic type may be used, and the surfactant used in a normal circulation type coolant system (circulation type rolling oil supply method) may be used.

As the first rolling oil emulsion 13, rolling oil obtained by diluting the above-described rolling oil preferably to a concentration of 2% to 8% by mass, more preferably to a concentration of 3% to 6.0% by mass, and forming an O/W emulsion in which the oil is dispersed in water using the above-described surfactant is used. The average particle diameter is preferably 15 μm or less, and more preferably 3 to 10 μm.

The dirty tank 5 for collecting the rolling oil emulsion and the clean tank 7 are connected via an iron powder removing device 6 including an iron powder amount control device and the like. A portion of the second rolling oil emulsion 15 in the dirty tank 5 is configured to move (be supplied) to the clean tank 7 side and be a portion of the first rolling oil emulsion 13 after a removal treatment of iron powder (wear powder) is performed by the iron powder removing device 6. The movement of the rolling oil emulsion from the dirty tank 5 side to the clean tank 7 side via the iron powder removing device 6 may be performed continuously or intermittently.

The iron powder removing device 6 preferably uses a magnet filter such as an electromagnetic filter or a magnet separator to adsorb and remove the iron powder, and the method is not limited to this method. The iron powder removing device 6 may be a known device using a method such as centrifugation. The iron powder removing device 6 is a device that performs the removal treatment of the oil-dissolved iron content of the second rolling oil emulsion 15 such that the oil-dissolved iron content becomes the oil-dissolved iron content acceptable as the first rolling oil emulsion 13. The oil-dissolved iron content of the first rolling oil emulsion 13 and the second rolling oil emulsion 15 is appropriately detected by a detection means (not illustrated). The detection means of the oil-dissolved iron content may be provided in each tank, or may be provided in the oil pipeline on the upstream side or the downstream side of each tank. In other aspects, the iron powder removing device itself may be provided with a detection means capable of detecting the oil-dissolved iron content before and after the removal treatment, the oil-dissolved iron content of the rolling oil before the removal treatment may be used as the oil-dissolved iron content of the first rolling oil emulsion 13, and the oil-dissolved iron content of the rolling oil after the removal treatment may be used as the oil-dissolved iron content of the second rolling oil emulsion 15.

Two systems, a first rolling oil supply system 2 and a second rolling oil supply system 14, may be provided as rolling oil supply systems to supply the rolling oil to the rolling stand of the cold tandem rolling mill and the steel sheet 1. The first rolling oil supply system 2 is configured to circulate and supply the first rolling oil emulsion 13 (rolling oil in which the rolling oil after the removal treatment of the wear powder generated by rolling and the neat oil of the rolling oil to be appropriately replenished are mixed) in the clean tank 7 to the rolling mill side. The second rolling oil supply system 14 is configured to supply (circulate and supply) the second rolling oil emulsion 15 in the dirty tank 5 containing the wear powder generated by rolling to the rolling mill side.

The rolling oil supplied from the first rolling oil supply system 2 and the rolling oil supplied from the second rolling oil supply system 14 are configured to be mixable in the mixing unit, and the mixed rolling oil mixed in the mixing unit is configured to be supplied to a target stand. In the example illustrated in FIG. 2, the mixing unit includes a flow control valve 18. The opening degree of the flow control valve 18 is adjusted in response to a command from a supply control unit 20, and a mixing ratio of the first rolling oil emulsion 13 to the second rolling oil emulsion 15 is adjusted by this adjustment.

The fifth stand, which is the final stand, and the fourth stand located on the upstream side of the fifth stand will be described as a target stand to which the mixed rolling oil is supplied (also referred to as a mixing target stand). That is, this is an example in which the fourth and fifth rolling stands (#4 STD, #5 STD) are defined as "selected rolling stands." Chattering is most likely to occur at the final stand.

The first rolling oil emulsion 13 is supplied by the first rolling oil supply system 2 for lubrication of the first to third stands.

First Rolling Oil Supply System 2

The first rolling oil supply system 2 includes a first rolling oil pipeline 9 (first rolling oil supply line) having one end portion connected to the dirty tank 5, the iron powder removing device 6, the clean tank 7, and a pump 8A.

The other end portion (rolling mill side) of the first rolling oil pipeline 9 is branched and connected to a lubricating coolant header 3 disposed on each of the first to third stands, a cooling coolant header 4 disposed on each of the first to fifth stands, and flow control valves 18A and 18B for the fourth and fifth stands (for mixing target stand), respectively. Squirt ports of the flow control valves 18A and 18B are connected to lubricating coolant headers 3A and 3B, which are the lubricating coolant headers 3 for the fourth and fifth stands.

Each lubricating coolant header 3 is disposed on the inlet side of the rolling stand, and supplies lubricating oil to the roll bite by ejecting rolling oil as the lubricating oil from each spray nozzle provided toward the roll bite. The cooling coolant header 4 is disposed on an outlet side of the rolling stand, and ejects the rolling oil from each spray nozzle provided toward a work roll to cool the work roll.

The iron powder removing device 6, the clean tank 7, and the pump 8A are interposed in the first rolling oil pipeline 9 from the upstream side (dirty tank 5) to the downstream side (rolling mill side) in this order.

As described above, the rolling oil emulsion (first rolling oil emulsion 13) to be circulated and used is stored in the clean tank 7. A strainer for removing foreign matter may be disposed between the clean tank 7 and the pump 8A.

With this configuration, in the first rolling oil supply system 2, the rolling oil from the dirty tank 5 is supplied to the clean tank 7 via the iron powder removing device 6, and the first rolling oil emulsion 13 in the clean tank 7 is pumped by the pump 8A. The pumped first rolling oil emulsion 13 is supplied to the above-described coolant headers 3 and 4 disposed in each rolling stand through the first rolling oil pipeline 9, and is configured to be supplied from the spray nozzle provided in each coolant header. In addition, the first rolling oil emulsion 13 supplied to the rolling roll is collected in the oil pan 10 except for the rolling roll taken out of the system by the steel sheet 1 or lost due to evaporation, and is returned into the dirty tank 5 through the return pipe 11. Thereafter, as described above, a portion of the rolling oil emulsion stored in the dirty tank 5 is returned to the clean tank 7 after a certain amount of the oil-dissolved iron content in the rolling oil emulsion generated by cold rolling is removed by the iron powder removing device 6. That is, a portion of the rolling oil emulsion collected in the dirty tank 5 is sent to the clean tank 7 after the properties are controlled by the iron powder removing device 6 to the oil-dissolved iron content set as the first rolling oil emulsion 13 to be circulated and used.

As described above, the rolling oil subjected to the wear removal treatment is circulated and supplied to the rolling rolls by the first rolling oil supply system 2. That is, the supplied first rolling oil emulsion 13 is circulated and used.

The clean tank 7 corresponds to a rolling oil tank for circulation in the circulating lubrication method in the related art, and as described above, the neat oil of rolling oil is appropriately replenished (supplied) to the clean tank 7.

Second Rolling Oil Supply System 14

As described above, this example includes a second rolling oil supply system 14 in addition to the first rolling oil supply system 2.

The second rolling oil supply system 14 includes a second rolling oil pipeline 16 having one end portion connected to the dirty tank 5, a strainer 17, and a pump 8B.

The second rolling oil emulsion 15 in the dirty tank 5 is the rolling oil after being used in rolling. Therefore, the second rolling oil emulsion 15 contains wear powder generated during rolling. As a result, the second rolling oil emulsion 15 in the dirty tank 5 is rolling oil having a higher iron powder concentration than that of the first rolling oil emulsion 13 in the clean tank 7. The dirty tank 5 is not replenished with the neat oil of rolling oil. In addition, the dirty tank 5 is washed every predetermined maintenance period, for example, every six months, to initialize the iron powder concentration.

The wear powder generated by rolling in the rolling mill may be contained in the rolling oil in the dirty tank 5. In addition to the above-described wear powder, or in place of the above-described wear powder, wear powder generated by another rolling mill may be added. In addition, even when the wear powder is a metal wear powder other than the iron powder, the metal wear powder other than the iron powder is not prevented from being mixed, provided that the metal wear can achieve the same chattering suppressing effect.

The other end portion of the second rolling oil pipeline 16 is connected to the flow control valve 18 constituting the mixing unit.

The strainer 17 and the pump 8B are interposed in the second rolling oil pipeline 16 from the dirty tank 5 toward the flow control valve 18 in this order.

The strainer 17 is installed to remove coarse materials such as huge wear from the second rolling oil emulsion 15.

In the second rolling oil supply system 14, the second rolling oil emulsion 15 having a high oil-dissolved iron content and stored in the dirty tank 5 is supplied to the flow control valve 18 through the second rolling oil pipeline 16 by driving the pump 8B. The second rolling oil emulsion 15 is mixed with the first rolling oil emulsion 13 in the flow control valve 18, and a mixed rolling oil containing the second rolling oil emulsion 15 containing a predetermined oil-dissolved iron content is formed. The mixed rolling oil is sent to the lubricating coolant headers 3 of the fourth and fifth stands and ejected toward the roll bite. Subsequently, when the rolling oil collected in the oil pan 10 is returned to the dirty tank 5 through the return pipe 11, the rolling oil becomes the second rolling oil emulsion 15 and is circulated and used.

Mixing Unit

The flow control valves 18A and 18B constituting the mixing unit are individually provided for each target stand, and the first rolling oil emulsion 13 and the second rolling oil emulsion 15 are individually supplied from the first rolling oil supply system 2 and the second rolling oil supply system 14. The opening degree of each flow control valve 18A and 18B is individually adjusted based on a command output from the supply control unit 20, and the flow rate of the first rolling oil emulsion 13 to the second rolling oil emulsion 15 is controlled. That is, by controlling the opening degrees of the flow control valves 18A and 18B, the first rolling oil emulsion 13 and the second rolling oil emulsion 15 are mixed at a specific mixing ratio, and supplied to each of the lubricating coolant headers 3A, and 3B. The flow control valves 18A and 18B may control the flow rate of the second rolling oil emulsion 15 with respect to the flow rate of the first rolling oil emulsion 13.

In the equipment configuration illustrated in FIG. 2, although the flow control valves 18A and 18B form the mixing unit, the rolling oil supplied from the first rolling oil supply system 2 and the rolling oil supplied from the second rolling oil supply system 14 are mixed by the flow control valves 18A and 18B, and the mixed rolling oil is supplied to the target stand via the lubricating coolant headers 3A and 3B, this example is not limited to this.

Figure 4:
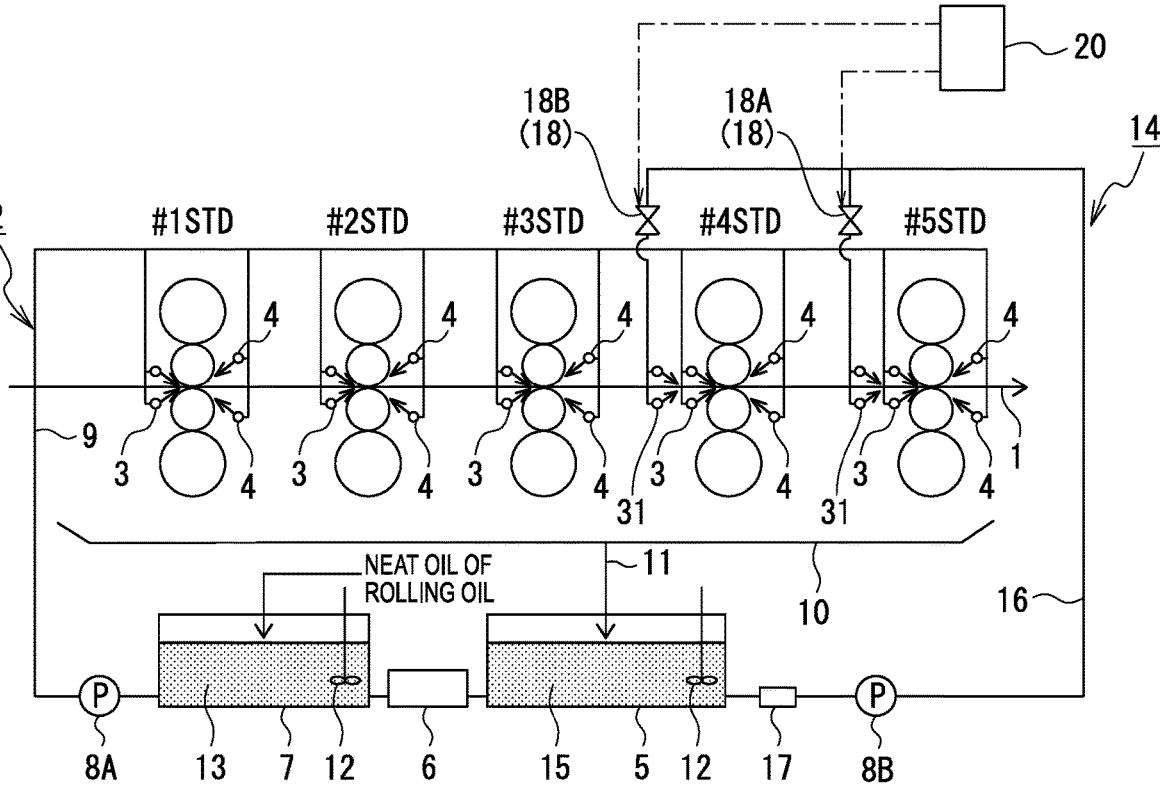
FIG. 4 is a diagram illustrating another schematic configuration of the cold rolling equipment according to the example.

For example, as illustrated in FIG. 4, the second rolling oil emulsion 15 supplied from the second rolling oil supply system 14 may be directly supplied to the steel sheet 1 via the lubricating coolant header 31, independent of the supply of rolling oil from the first rolling oil supply system 2 via the lubricating coolant header 3, without providing a mixing unit in the middle of the pipeline. In this example, the rolling oil supplied from the second rolling oil supply system 14 on the steel sheet 1 is mixed with the rolling oil supplied from the first rolling oil supply system 2 by the movement of the steel sheet 1. The flow control valves 18A and 18B in FIG. 4 do not form a mixing unit, and are for individually adjusting the rolling supply amount from each lubricating coolant header 31. However, rather than the configuration illustrated in FIG. 4, it is more preferable that the first rolling oil emulsion 13 and the second rolling oil emulsion 15 are mixed in advance in the rolling oil pipeline as illustrated in FIG. 2 and then supplied, as will be described later.

In addition, the temperature condition of the second rolling oil emulsion 15 is preferably the same as the temperature condition of the first rolling oil emulsion 13. However, from the viewpoint of improving the cooling ability of the steel sheet in the latter-stage stand, the temperature of the second rolling oil emulsion 15 may be lower than that of the first rolling oil emulsion 13 via a cooling device (not illustrated). In addition, the concentration condition of the rolling oil in the second rolling oil emulsion 15 is not required to be the same as that of the first rolling oil emulsion 13, and the concentration may be adjusted by merging the second rolling oil emulsion 15 and a neat oil tank of rolling oil (not illustrated). In that example, a supply system from the neat oil tank of rolling oil merges with the second rolling oil supply system 14 between the pump 8 and the flow control valve 18, for example, and the concentration of the second rolling oil emulsion 15 can be adjusted. By adding the neat oil of rolling oil to the second rolling oil emulsion 15, the concentration of the second rolling oil emulsion 15 can be made higher than the concentration of the first rolling oil emulsion 13. Examples of when it is desirable to have a high concentration of the second rolling oil emulsion 15 include when high load rolling, a high-speed rolling, the first rolling oil emulsion 13 has a low concentration and the like. For example, high load rolling is rolling a rolled material having high strength (for example, electrical steel sheet having a Si content of more than 3% by mass described later) and a wide width. For example, high-speed rolling is when the rolling speed exceeds 2000 mpm. For example, the first rolling oil emulsion 13 has a low concentration is when the concentration of the first rolling oil emulsion 13 changes to a concentration lower than a predetermined concentration by repeating the circulation supply of the rolling oil.

In the cold tandem rolling mill illustrated in FIG. 2, an example where the second rolling oil supply system 14 is provided on each inlet side of the fifth (final) rolling stand #5 STD and the fourth rolling stand #4 STD which is an adjacent rolling stand of the fifth rolling stand is illustrated. The amount of rolling oil emulsion supplied to each of the lubricating coolant headers 3 of the fourth rolling stand #4 STD and the fifth rolling stand #5 STD is adjusted by the individual flow control valves 18A and 18B. The fourth rolling stand #4 STD is an adjacent rolling stand of the final rolling stand #5 STD, and is also an upstream rolling stand located in a previous stage, that is, upstream.

In rolling oil supply equipment as described above, low-concentration rolling oil emulsion is supplied to the roll bite on the inlet side and the outlet side of each rolling stand by the first rolling oil supply system 2 which employs a circulation type rolling oil supply method. Therefore, the steel sheet 1 and the roll are lubricated and cooled. Since the first rolling oil supply system 2 circulates and uses the rolling oil, the basic unit of the rolling oil is low.

Furthermore, the second rolling oil emulsion 15 having a higher oil-dissolved iron content than that of the first rolling oil emulsion 13 is supplied to the roll bite by the second rolling oil supply system 14 on each inlet side of the final rolling stand #5 STD, which is the latter-stage rolling stand where the rolling speed is relatively high, and the fourth rolling stand #4 STD adjacent to the final rolling stand. By supplying the rolling oil emulsion from the second rolling oil supply system 14, the friction coefficient during cold rolling is controlled to eliminate chattering in a wide rolling speed range. Suppression of chattering can be realized by appropriately maintaining the balance of the lubrication state between the final rolling stand #5 STD and the adjacent fourth rolling stand #4 STD which affects the final rolling stand #5 STD via the tension between the rolling stands. Specifically, chattering is suppressed by appropriately maintaining the balance of the friction coefficient between the final rolling stand #5 STD and the fourth rolling stand #4 STD, which are two adjacent rolling stands.

As described above, it is important to control the oil-dissolved iron content of the mixed rolling oil supplied to the inlet side of the mixing target stand to appropriately adjust the friction coefficient at the final rolling stand #5 STD.

Supply Control Unit 20

Next, a method of controlling the supply of mixed rolling oil (control of the mixing ratio) will be described. Since the first rolling oil emulsion 13 is mixed with the second rolling oil emulsion 15, the mixed rolling oil may be referred to as the second rolling oil emulsion 15. On the upstream side of the flow control valve 18, the second rolling oil emulsion 15 means rolling oil in which the first rolling oil emulsion 13 is not mixed. On the downstream side of the flow control valve 18, the second rolling oil emulsion means a mixed rolling oil in which the first rolling oil emulsion 13 is mixed.

A target friction coefficient at the fifth rolling stand #5 STD, which is the final rolling stand, may be set from the friction coefficient at the adjacent fourth rolling stand #4 STD, and the required oil-dissolved iron content in the second rolling oil emulsion 15 required to obtain the target friction coefficient is predicted. The mixing ratio of the first rolling oil supply system 2 to the second rolling oil supply system 14 is feedback (FB)-controlled by the flow control valve 18 to be the estimated required oil-dissolved iron content. The control content is the same even when the fourth rolling stand #4 STD, which is an adjacent rolling stand, is not the mixing target stand.

The adjustment of the friction coefficient at the fifth rolling stand by the rolling oil supplied from the second rolling oil supply system 14 will be described in detail.

Figure 3:
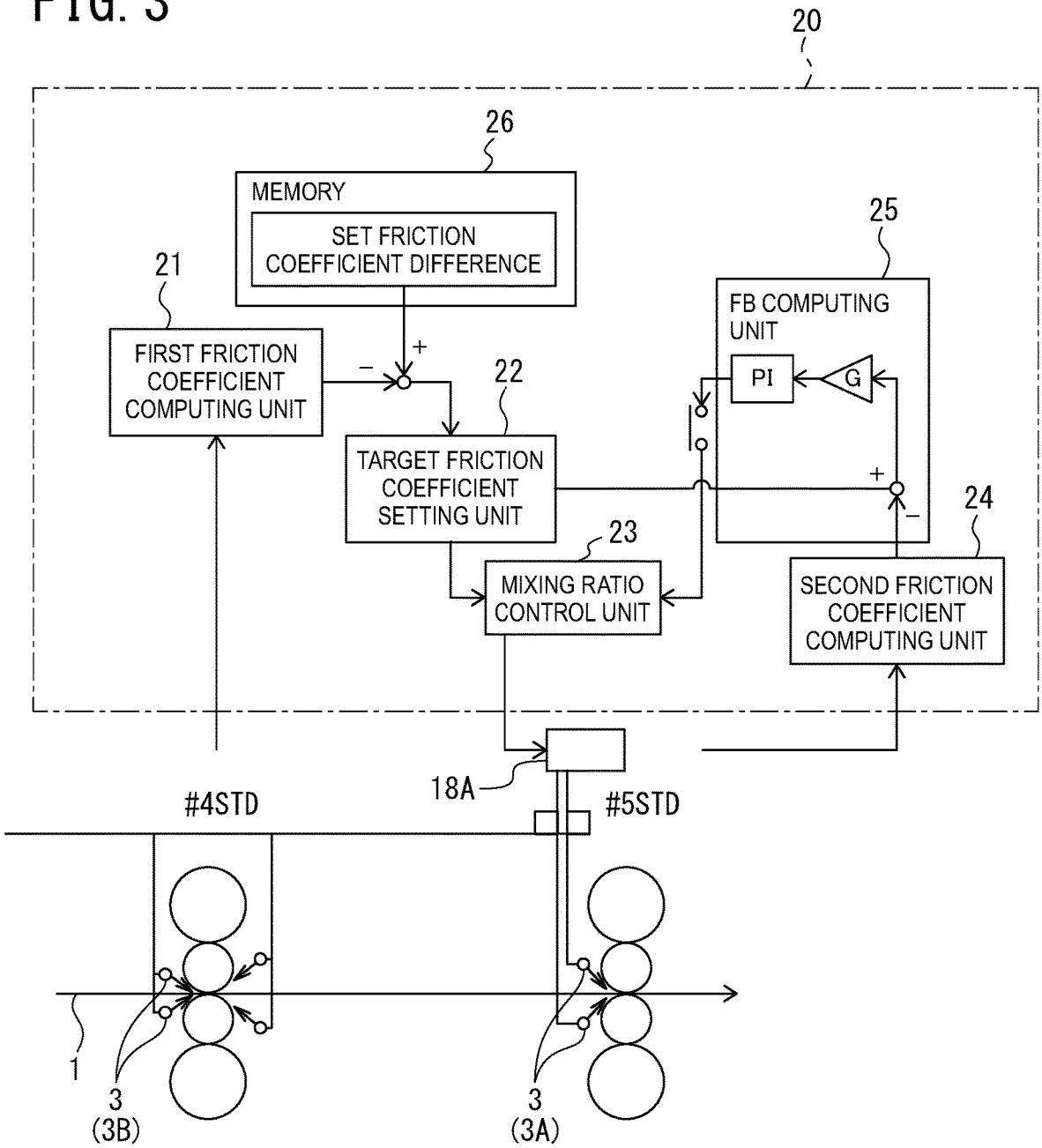
FIG. 3 is a diagram describing a configuration of a supply control unit according to the example.

FIG. 3 is a diagram illustrating a control block of the supply control unit 20 that controls the supply of the second rolling oil emulsion 15 of the example (however, treatment portion at the fifth rolling stand).

As illustrated in FIG. 3, the supply control unit 20 includes a first friction coefficient computing unit 21, a target friction coefficient setting unit 22, a mixing ratio control unit 23, a second friction coefficient computing unit 24, an FB computing unit 25, and a memory 26 (storage unit). The supply control unit 20 may be built in the cold tandem rolling mill, or may be built in an operation panel connected to the cold tandem rolling mill wirelessly or by wire. The operation panel is an operation member used when an operator himself/herself sets rolling conditions and the like by the cold tandem rolling mill.

The first friction coefficient computing unit 21 obtains the friction coefficient at the fourth rolling stand (adjacent rolling stand #4 STD). This fourth rolling stand constitutes an upstream stand adjacent to the final rolling stand. For example, the first friction coefficient computing unit 21 inversely calculates (estimates) the friction coefficient at the fourth rolling stand #4 STD by a rolling model such as Bland & Ford from the rolling results at the fourth rolling stand #4 STD. The relationship between the advanced rate and the friction coefficient and the relationship between the rolling load and the friction coefficient are clarified by rolling models such as Bland & Ford, and the friction coefficient of the adjacent rolling stand #4 STD can be estimated by using such a relational expression.

In addition, the second friction coefficient computing unit 24 also inversely calculates (estimates) the friction coefficient at the fifth rolling stand #5 STD from the rolling results at the final rolling stand #5 STD, similarly to the first friction coefficient computing unit 21. Information acquisition for computing the friction coefficient is performed when the steel sheet 1 is bitten into the fifth rolling stand #5 STD and rolling is started at the fifth rolling stand #5 STD.

In addition, the target friction coefficient setting unit 22 obtains the target friction coefficient at the fifth rolling stand from the first friction coefficient computing unit 21 and a set friction coefficient difference stored in advance in the memory 26. That is, the target friction coefficient setting unit 22 sets the target friction coefficient at the fifth rolling stand #5 STD from the friction coefficient at the adjacent fourth rolling stand calculated by a rolling model such as Bland & Ford and the absolute value of the friction coefficient difference between the fifth rolling stand #5 STD and the adjacent rolling stand set in advance.

The absolute value of the friction coefficient difference, which is the set friction coefficient difference, is preferably set to be 0 or more and 0.01 or less. This is because when the difference between the two friction coefficients exceeds the above range, the phase difference in the amplitude of the work roll between the fifth rolling stand and the adjacent rolling stand fluctuates and is unstable, and thus chattering is likely to occur.

The FB computing unit 25 computes the control amount of the feedback control. For example, the FB computing unit 25 obtains the deviation between the friction coefficient of the final rolling stand #5 STD inversely calculated (estimated) by the second friction coefficient computing unit 24 and the target friction coefficient set by the target friction coefficient setting unit 22. Next, after multiplying the obtained deviation by a gain G set in advance, the proportional integration (PI) term is computed to obtain the feedback control amount, and the obtained feedback control amount is output to the mixing ratio control unit 23. The output of the feedback control amount is assumed to be when the steel sheet 1 is bitten into the fifth rolling stand #5 STD.

The mixing ratio control unit 23 obtains the mixing ratio of the rolling oil of the first rolling oil supply system 2 (first rolling oil emulsion 13) to the second rolling oil supply system 14 (second rolling oil emulsion 15) to be supplied to the inlet side of the fifth rolling stand #5 STD, such that the friction coefficient at the fifth rolling stand #5 STD is the target friction coefficient set by the target friction coefficient setting unit 22, and supplies a command of the obtained mixing ratio to the flow control valve 18A for the fifth rolling stand. In this manner, the mixing ratio control unit 23 feedback-controls the friction coefficient at the fifth rolling stand #5 STD. That is, the second rolling oil emulsion 15 supplied to the fifth rolling stand #5 STD is adjusted to have a predetermined iron powder concentration. The mixing ratio of the first rolling oil supply system 2 to the second rolling oil supply system 14 forming the second rolling oil emulsion 15 is controlled by adjusting the opening degree of each flow control valve 18.

The feedback control is performed as follows. The mixing ratio R of the second rolling oil emulsion 15 at the inlet side of the fifth stand is set by equation (1) using the target friction coefficient μset at the fifth rolling stand #5 STD set by the target friction coefficient setting unit 22, and the friction coefficient $\mu_5$ inversely calculated from the rolling results at the fifth rolling stand #5 STD using a rolling model such as Bland & Ford:

$$R = G_{FB} \cdot K_P\left(1 + \frac{K_1}{S}\right) \cdot (\mu_{set} - \mu_5) \tag{1}$$

wherein, $G_{FB}$: Adjustment gain of feedback control $K_P$: Proportional gain of feedback control $K_I$: Integrated feedback gain S: Integration time.

In addition, when chattering is unlikely to occur such as rolling using a soft material that does not cause insufficient lubrication as a rolled material, rolling at low speed, or rolling at an acceleration and deceleration unit, the rolling oil may not be adjusted by the above feedback control. That is, when chattering is unlikely to occur, the mixing ratio set for each operating condition or common to all operating conditions where chattering does not occur may be used, and the same effect can be obtained even when the above feedback control is performed only when the operating conditions are such that chattering is likely to occur.

In the above description, the adjustment of the mixing ratio in the flow control valve 18A for controlling the mixing ratio (control of the friction coefficient) in the fifth rolling stand is described.

The control of the mixing ratio by the flow control valve 18B for the fourth rolling stand may be performed in the same manner as the control of the mixing ratio by the flow control valve 18A for the fifth rolling stand, for example. That is, the friction coefficient at the third rolling stand located adjacent to the fourth rolling stand and on the upstream side is computed, and a target friction coefficient is set such that the absolute value of the friction coefficient difference from the friction coefficient is 0 or more and 0.01 or less. Next, the flow control valve 18B for the fourth rolling stand is controlled such that the computed friction coefficient at the fourth rolling stand is the set target friction coefficient, and the mixing ratio of the rolling oil is controlled. The target friction coefficient at the fourth rolling stand may be set regardless of the friction coefficient at the third rolling stand, and the flow control valve 18B for the fourth rolling stand may be feedback-controlled.

When this disclosure is organized by focusing on the rolling method, it can be said that the rolling method includes the following steps of supplying rolling oil to a plurality of rolling stands for rolling the rolled material.

That is, the rolling method includes a collection step of collecting the rolling oil used in the plurality of rolling stands #1 STD to #5 STD into the oil pan 10.

In addition, the rolling method includes a removing treatment step in which a portion of the rolling oil in the dirty tank 5 is subjected to an iron powder removing treatment by the iron powder removing device 6.

In addition, the rolling method includes a storage step of storing the rolling oil subjected to the removal treatment by the iron powder removing device 6 in a clean tank to which the stock oil of the rolling oil is supplied.

In addition, the rolling method includes a coolant header supply step of supplying the rolling oil in the clean tank 7 to the cooling coolant headers 4 of all the rolling stands.

In addition, the rolling method includes a first coolant header supply step of supplying the rolling oil in the clean tank 7 to the lubricating coolant header 3 of the rolling stand other than the mixing target stand.

In addition, the rolling method includes a rolling oil mixing step of supplying and mixing the rolling oil in the dirty tank 5 and the clean tank 7 to the flow control valves 18A and 18B constituting the mixing unit.

In addition, the rolling method constitutes a second coolant header supply step of supplying the rolling oil mixed by the rolling oil mixing step to the sliding coolant header of the mixing target stand (this step corresponds to "supplying").

Operation and Others

In the rolling, the first rolling oil emulsion 13 stored in the clean tank 7 is circulated and supplied to each rolling stand by the first rolling oil supply system 2, and lubrication and cooling treatments at each rolling stand are performed.

Furthermore, the device includes the second rolling oil supply system 14 that circulates and uses the second rolling oil emulsion 15 having a relatively high wear powder concentration, in addition to the first rolling oil supply system 2. The fourth and fifth rolling stands, particularly the fifth rolling stand, which chattering is relatively likely to occur, may be set as the mixing target stands. As for the rolling oil supplied to the mixing target stand, the mixed rolling oil formed by mixing the first rolling oil emulsion 13 from the first rolling oil supply system 2 with the second rolling oil emulsion 15 of the second rolling oil supply system 14 is supplied for lubrication at the mixing target stand. Similarly to the other stands, the first rolling oil emulsion 13 is used as it is for cooling at the fourth and fifth rolling stands.

The wear powder concentration of the second rolling oil emulsion 15 in the dirty tank 5 is higher than the wear powder concentration of the first rolling oil emulsion 13 because the second rolling oil emulsion 15 does not pass through the iron powder removing device 6. As a result, the content of wear powder in the mixed rolling oil supplied to the target rolling stand can be adjusted to be higher than that of the first rolling oil emulsion 13, as necessary. Therefore, the adjustable range of the friction coefficient at the fourth and fifth rolling stands, especially the fifth rolling stand, may be increased, and chattering at the fourth and fifth rolling stands, especially at the fifth rolling stand, can be suppressed.

As described above, the example has the following effects.

(1) There is provided a rolling method that rolls a rolled material by a tandem rolling mill including a plurality of rolling stands, the method including: supplying by mixing rolling oil supplied from a first rolling oil supply system and a second rolling oil supply system to one or two or more rolling stands selected from the plurality of rolling stands, in which the first rolling oil supply system circulates and supplies rolling oil subjected to a removal treatment of wear powder generated by the rolling, and the second rolling oil supply system supplies rolling oil containing the wear powder generated by the rolling.

For example, the rolling device includes a tandem rolling mill including a plurality of rolling stands; a first rolling oil supply system 2 configured to circulate and supply rolling oil after a removal treatment of wear powder generated by rolling; a second rolling oil supply system 14 configured to supply rolling oil containing the wear powder generated by rolling; and a mixing unit configured to mix rolling oil supplied from the first rolling oil supply system 2 and rolling oil supplied from the second rolling oil supply system 14 to obtain mixed rolling oil, in which the mixed rolling oil thus mixed is supplied to one or more rolling stands selected from the plurality of rolling stands.

From another point of view, the rolling method can also be expressed as follows, for example.

(1-1) That is, the rolling method is a rolling method that rolls a rolled material by a tandem rolling mill including a plurality of rolling stands, the method including: supplying rolling oil supplied from a first rolling oil supply system and a second rolling oil supply system to one or two or more rolling stands selected from the plurality of rolling stands, in which the first rolling oil supply system circulates and supplies first rolling oil subjected to a removal treatment of a wear powder generated by the rolling, and the second rolling oil supply system supplies second rolling oil containing the wear powder generated by the rolling, in which mixed oil in which the first rolling oil and the second rolling oil are mixed is supplied to the upstream side of each rolling stand of the selected one or two or more rolling stands, and the first rolling oil is supplied to the downstream side of each rolling stand.

(1-2) In addition, the rolling method is a rolling method that rolls a rolled material by a tandem rolling mill including a plurality of rolling stands, the method including: a first supply step of supplying rolling oil supplied from a first rolling oil supply system to the plurality of rolling stands; and a second supply step of supplying by mixing the rolling oil supplied from the first rolling oil supply system and a second rolling oil supply system to one or two or more rolling stands disposed on the downstream side in the rolling direction in the plurality of rolling stands, in which the first rolling oil supply system circulates and supplies rolling oil subjected to a removal treatment of wear powder generated by the rolling, and the second rolling oil supply system supplies rolling oil containing the wear powder generated by the rolling.

According to the above configuration, chattering can be suppressed by increasing the content of wear powder in the rolling oil supplied to the rolling stand as necessary. As a result, in tandem rolling provided with a circulating lubrication method, it is possible to provide the rolling technology such as cold rolling capable of corresponding high-speed rolling.

(2) In addition, the example includes performing a removal treatment of wear powder on rolling oil collected from the plurality of rolling stands, in which the first rolling oil supply system is configured to supply the collected rolling oil after the removal treatment, and the second rolling oil supply system is configured to supply the collected rolling oil.

For example, the rolling device includes a collection tank configured to store rolling oil collected from a rolling stand, in which the first rolling oil supply system 2 has a first rolling oil pipeline 9 configured to supply the rolling oil from the collection tank to the mixing unit, and a wear powder removing device interposed with the rolling oil pipeline, and the second rolling oil supply system 14 has a second rolling oil pipeline 16 configured to supply the rolling oil in the collection tank to the mixing unit.

According to this configuration, the rolling oil in the collection tank collected from the rolling stand can be used as the rolling oil of the first rolling oil supply system 2 and the second rolling oil supply system 14.

(3) In addition, the example includes storing the collected rolling oil after the removal treatment in a storage tank to which a neat oil of rolling oil is replenished, in which the first rolling oil supply system is configured to supply the rolling oil stored in the storage tank.

For example, the rolling device is configured to include the clean tank 7 to which a neat oil of rolling oil is replenished on the downstream side from an interposition location of the wear powder removing device in the rolling oil pipeline.

According to this configuration, the rolling oil containing a relatively high concentration of wear powder can be supplied by the second rolling oil supply system 14, while stably supplying rolling oil of a predetermined concentration by the first rolling oil supply system 2.

(4) In addition, in the example, the number of rolling stands to which the rolling oil is supplied is two or more, and the supplying is able to be individually performed for each rolling stand to which the rolling oil is supplied.

For example, in the rolling device, the number of rolling stands to which the rolling oil is supplied is two or more, and the mixing unit is individually provided for each rolling stand to which the rolling oil is supplied.

According to this configuration, it is possible to optimize the friction coefficient for each target rolling stand.

(5) In addition, in the example, the selected rolling stand includes a final rolling stand, and in the supplying to the final rolling stand, a mixing ratio of the rolling oil of the first rolling oil supply system to the rolling oil of the second rolling oil supply system is controlled based on a friction coefficient at the final rolling stand and a friction coefficient at an upstream stand, which is a rolling stand located upstream from the final rolling stand.

For example, in the rolling device, the rolling stand (selected rolling stand) to which the mixed rolling oil is supplied includes a final rolling stand, when one of the rolling stands located on the upstream side of the final rolling stand is described as an upstream stand, the device includes a mixing ratio control unit 23 configured to obtain a mixing ratio of the rolling oil of the first rolling oil supply system 2 to the rolling oil of the second rolling oil supply system 14 in the mixed rolling oil supplied to the final rolling stand based on a friction coefficient at the final rolling stand and a friction coefficient at the upstream stand, and the rolling oil of the first rolling oil supply system 2 and the rolling oil of the second rolling oil supply system 14 are mixed in the mixing unit to have a mixing ratio supplied from the mixing ratio control unit 23.

According to this configuration, by controlling the amount of wear powder of the second rolling oil emulsion 15 at the final rolling stand where chattering is relatively likely to occur, there is an effect that the balance of friction coefficients in the two rolling stands is appropriately maintained and the occurrence of chattering can be suppressed.

(6) In addition, in the example, a target friction coefficient at the final rolling stand is set such that an absolute value of a difference between the friction coefficient at the final rolling stand and the friction coefficient at the upstream stand is 0 or more and 0.01 or less, and the mixing ratio of the mixed rolling oil supplied to the final rolling stand is controlled such that the friction coefficient at the final rolling stand is the set target friction coefficient.

For example, in the rolling device example, the device includes a first friction coefficient computing unit 21 configured to obtain a friction coefficient at the upstream stand; and a target friction coefficient setting unit 22 configured to set the target friction coefficient at the final rolling stand such that an absolute value of a difference between the friction coefficient at the final rolling stand and the friction coefficient at the upstream stand is 0 or more and 0.01 or less, in which the mixing ratio control unit 23 controls the mixing ratio of the mixed rolling oil to the final rolling stand such that the friction coefficient at the final rolling stand is the target friction coefficient set by the target friction coefficient setting unit 22.

According to this configuration, there is an effect that an appropriate balance of friction coefficients between the two rolling stands is more reliably maintained and the occurrence of chattering can be suppressed.

(7) A metal sheet such as a steel sheet 1 is produced by rolling a rolled material using the rolling method.

According to this configuration, a rolled product of high-strength and thin material can be produced with a reduced yield.

Others

The number of rolling stands (mixing target stands) for supplying the mixed rolling oil mixed with the second rolling oil emulsion 15 may be one or three or more. When the second rolling oil supply system 14 is provided on each inlet side of three or more rolling stands, the flow control valve 18 may be provided for each rolling stand, or one flow control valve 18 may be provided for a plurality of rolling stands. For example, one flow control valve 18 may be provided for the final (fifth) rolling stand, and one common flow control valve 18 may be provided for the third rolling stand and the fourth rolling stand.

The mixing target stand may not include the final rolling stand, and it is desirable that the final rolling stand is included because chattering mainly occurs at the final rolling stand. In addition, when there is only one mixing target stand, it is preferable that the mixing target stand is the final rolling stand.

The number of stands in the tandem rolling mill is not limited to 5, and a tandem rolling mill including 4 or less or 6 or more stands may be employed.

EXAMPLE

Hereinafter, our methods and devices will be described based on examples.

Cold rolling was performed using a tandem rolling mill including totally five rolling stands of the example illustrated in FIG. 2, and a hard black plate having a base material thickness of 2.0 mm and a sheet width of 900 mm (original sheet with tempering degree in JIS G 3303 of T4CA class) was used as a rolled material and rolled to a finished thickness of 0.180 mm by appropriately adjusting the target rolling speed.

As the neat oil of rolling oil, a neat oil was used in which each of an oil-based agent and an antioxidant was added in an amount of 1% by mass, and a nonionic surfactant as a surfactant was added in an amount of 3% by mass based on the oil concentration to base oil with vegetable oil added to the base of synthetic ester oil.

The first rolling oil emulsion 13 supplied from the first rolling oil supply system 2 to be circulated and used was adjusted to rolling oil emulsion having a rolling oil concentration of 3.5% by mass, an average particle diameter of 8 μm, and a temperature of 55° C.

Example 1

In Example 1, the above-described hard black plate was used as a rolled material, the first rolling oil emulsion 13 was supplied to the first to fourth rolling stands #1 to #4 STD, the mixing ratio of the rolling oil emulsion supplied from the first rolling oil supply system 2 and the second rolling oil supply system 14 to the final rolling stand #5 STD was adjusted to a predetermined mixing ratio, and the second rolling oil emulsion 15 having a higher iron content and oil-dissolved iron content than those of the first rolling oil emulsion 13 was supplied. The target rolling speeds were 1800 mpm, 2000 mpm, and 2200 mpm.

Example 2

In Example 2, the above-described hard black plate was used as a rolled material, the mixing ratio for setting the friction coefficient $\mu_5$ at the final rolling stand #5 STD to the target friction coefficient μset was calculated by feedback control based on the control of equation (1), and the rolling oil emulsion supplied from the first rolling oil supply system 2 and the second rolling oil supply system 14 was mixed with the calculated mixing ratio. As described above, the target friction coefficient μset was set such that the difference between the friction coefficient at the adjacent rolling stand #4 STD and the friction coefficient at the final rolling stand #5 STD was 0 or more and 0.01 or less. The other conditions were the same as those in Example 1.

Comparative Example 1

As Comparative Example 1, the above-described hard black plate was used as a rolled material, a feedback mechanism using a second rolling oil emulsion 15 having a concentration higher than that of the first rolling oil emulsion 13 described in JP '772 was provided, and the flow rate of the second rolling oil emulsion 15 was feedback-controlled such that the difference in friction coefficient between the rolling stand adjacent to the final rolling stand #5 STD and the final rolling stand #5 STD was within a certain range. The target range of the friction coefficient difference was the same as that in Example 2.

Example 3

In Example 3, rolling was performed using a material steel sheet for an electrical steel sheet illustrated below as a rolled material. However, the lubrication conditions with the rolling oil were the same as those in Example 1.

Rolling conditions: A material steel sheet for an electrical steel sheet containing a Si content of 3% by mass and having a base material thickness of 2.0 mm and a sheet width of 1000 mm was rolled as a rolled material to a finished thickness of 0.300 mm with target rolling speeds of 200 mpm, 600 mpm, 800 mpm, and 1000 mpm. It was found that the material steel sheet for the electrical steel sheet was harder than the hard black plate and chattering was likely to occur at a lower rolling speed.

Example 4

In Example 4, rolling was performed under the same rolling conditions as those in Example 3. However, the lubrication conditions with the rolling oil were the same as those in Example 2.

Example 5

In Example 5, rolling was performed under the same rolling conditions as those in Example 3. However, the configuration (configuration in which the first rolling oil emulsion 13 and the second rolling oil emulsion 15 were individually supplied to the steel sheet without forming a mixing unit in the pipeline) illustrated in FIG. 4 was adopted, and the mixing ratio supplied to the roll bite was the same as that in Example 2.

Comparative Example 2

In Comparative Example 2, rolling was performed under the same rolling conditions as those in Example 3. However, the lubrication conditions with rolling oil were the same as those in Comparative Example 1.

Evaluation

By supplying the rolling oil as described above, the actual friction coefficient and the chattering occurrence status at the #4 rolling stand and the final rolling stand #5 STD when rolling from low-speed to high-speed was performed in each of the Examples and Comparative Examples were confirmed. The results are illustrated in Tables 1 and 2.

The actual friction coefficient is a value inversely calculated from the rolling load, tension, and the like at the rolling speed.

TABLE 1

| Hard black plate | | 1800 mpm | 2000 mpm | 2200 mpm |
|---|---|---|---|---|
| Example 1 | #4 stand friction coefficient | 0.020 | 0.021 | 0.020 |
| | Final stand friction coefficient | 0.014 | 0.012 | 0.009 |
| | Chattering | A | A | B |
| Example 2 | #4 stand friction coefficient | 0.019 | 0.020 | 0.018 |
| | Final stand friction coefficient | 0.013 | 0.013 | 0.012 |
| | Chattering | A | A | A |
| Comparative Example 1 | #4 stand friction coefficient | 0.018 | 0.019 | 0.019 |
| | Final stand friction coefficient | 0.011 | 0.010 | 0.008 |
| | Chattering | A | A | C |

TABLE 2

| Electrical steel sheet | | 200 mpm | 600 mpm | 800 mpm | 1000 mpm |
|---|---|---|---|---|---|
| Example 3 | #4 stand friction coefficient | 0.026 | 0.024 | 0.023 | 0.023 |
| | Final stand friction coefficient | 0.017 | 0.015 | 0.013 | 0.012 |
| | Chattering | A | A | A | B |
| Example 4 | #4 stand friction coefficient | 0.025 | 0.023 | 0.023 | 0.023 |
| | Final stand friction coefficient | 0.018 | 0.016 | 0.015 | 0.014 |
| | Chattering | A | A | A | A |
| Example 5 | #4 stand friction coefficient | 0.025 | 0.023 | 0.023 | 0.022 |
| | Final stand friction coefficient | 0.017 | 0.015 | 0.012 | 0.011 |
| | Chattering | A | A | B | B |
| Comparative Example 2 | #4 stand friction coefficient | 0.026 | 0.024 | 0.024 | 0.023 |
| | Final stand friction coefficient | 0.015 | 0.013 | 0.012 | 0.011 |
| | Chattering | A | B | C | C |

In the table, A, B, and C indicate the following:

A . . . No chattering occurs

B . . . Slight chattering occurs (minute fluctuation in sheet thickness occurs)

C . . . Chattering occurs (excessive fluctuation in sheet thickness occurs).

According to Examples 1 and 2, in cold rolling on the hard black plate, when the rolling speed was 2000 mpm or less, we found that the absolute value of the difference in friction coefficient between the fourth rolling stand and the final rolling stand could be maintained at 0.01 or less and chattering could be prevented whether the mixing ratio was a predetermined mixing ratio or a mixing ratio under FB control. On the other hand, when the rolling speed was 2200 mpm or more, when the mixing ratio was set to a predetermined mixing ratio, we found that the absolute value of the difference in friction coefficient exceeded 0.01, and slight chattering occurred. As illustrated in Comparative Example 1, in the method of JP '772, when the rolling speed was 2200 mpm or more, the absolute value of the difference in the friction coefficient exceeded 0.01, a large amount of chattering occurred, and the surface quality and sheet thickness accuracy were reduced.

According to Examples 3 to 5, in cold rolling on the electrical steel sheet having a Si content of 3% by mass, when the rolling speed was 800 mpm or less, we found that the absolute value of the difference in friction coefficient between the fourth rolling stand and the final rolling stand could be maintained at 0.01 or less and chattering could be prevented whether the mixing ratio was a predetermined mixing ratio or a mixing ratio under FB control. On the other hand, when the rolling speed was 1000 mpm or more, when the mixing ratio was set to a predetermined mixing ratio, we found that the absolute value of the difference in friction coefficient exceeded 0.01, and slight chattering occurred.

In addition, when the first rolling oil emulsion 13 and the second rolling oil emulsion 15 are directly supplied to the steel sheet without being mixed as in Example 5, since the iron contained in the second rolling oil emulsion 15 is supplied to the roll bite without being sufficiently dispersed, we found that a discontinuous increase in the friction coefficient was caused, the absolute value of the difference in the friction coefficient exceeded 0.01, and slight chattering occurred.

As illustrated in Comparative Example 2, in the method of JP '772, when the rolling speed was 1000 mpm or more, the absolute value of the difference in the friction coefficient exceeded 0.01, a large amount of chattering occurred, and the surface quality and sheet thickness accuracy were reduced.

In addition, in Comparative Examples 1 and 2, the consumption of the rolling oil increased by 20% as compared to the examples by continuing to use the rolling oil emulsion of another system having a high concentration.

As described above, the material steel sheet for the electrical steel sheet is harder than the hard black plate, and the rolling speeds at which the mixing ratio is required to be calculated by feedback control are different. Therefore, in changing the calculation method of the mixing ratio according to the rolling speed, it is desirable to consider the type of rolled material. In particular, when a plurality of types of rolled materials is rolled on the same rolling line, it may be possible to switch whether the mixing ratio is controlled to a predetermined mixing ratio or controlled by feedback control based on the type of rolled material and the rolling speed.

As described above, by using our lubricating oil supply method, we confirmed that the friction coefficient at the latter-stage rolling stand could be kept within an appropriate range even at a wide range of rolling speeds, and the steel sheet 1 having high productivity, good shape, and sheet thickness accuracy could be obtained stably.

The entire contents of the Japanese patent application No. 2019-135593 (filed on Jul. 23, 2019), for which this application claims priority, form a portion of this disclosure by reference. Herein, although description has been made with reference to a limited number of examples, the scope of rights is not limited thereto, and modifications of each example based on the above disclosure are obvious to those skilled in the art.

The invention claimed is:

1. A rolling method that rolls a rolled material by a tandem rolling mill including a plurality of rolling stands, the method comprising:

supplying by mixing rolling oil supplied from a first rolling oil supply system and a second rolling oil supply system to one or two or more rolling stands selected from the plurality of rolling stands, and performing a removal treatment of the wear powder on rolling oil in a first storage tank and supplying rolling oil in the first storage tank to a second storage tank, wherein the first storage tank stores rolling oil collected from the plurality of rolling stands, the second storage tank stores rolling oil after performing the removal treatment of the wear powder generated by rolling, the first rolling oil supply system circulates and supplies rolling oil subjected to a removal treatment of wear powder generated by the rolling and stored in the second storage tank, and the second rolling oil supply system supplies rolling oil containing the wear powder generated by the rolling and stored in the first storage tank.

2. The rolling method according to claim 1, further comprising:

storing the collected rolling oil after performing the removal treatment in a storage tank to which a neat oil of rolling oil is replenished, wherein the first rolling oil supply system is configured to supply the rolling oil stored in the storage tank.

3. The rolling method according to claim 1, wherein the selected rolling stands are two or more rolling stands, and the supplying of the rolling oil is able to be individually performed for each of the selected rolling stands.

4. The rolling method according to claim 1, wherein the selected rolling stands include a final rolling stand, and in the supplying of the rolling oil to the final rolling stand, a mixing ratio of the rolling oil of the first rolling oil supply system to the rolling oil of the second rolling oil supply system is controlled based on a friction coefficient at the final rolling stand and a friction coefficient at an upstream stand, the upstream stand being a rolling stand located upstream of the final rolling stand.

5. The rolling method according to claim 4, wherein a target friction coefficient at the final rolling stand is set such that an absolute value of a difference between the friction coefficient at the final rolling stand and the friction coefficient at the upstream stand is 0 or more and 0.01 or less, and the mixing ratio is controlled such that the friction coefficient at the final rolling stand is the set target friction coefficient.

6. A production method for a metal sheet, comprising:

producing a metal sheet by rolling a rolled material using the rolling method according to claim 1.

7. The rolling method according to claim 1, wherein the selected rolling stands are two or more rolling stands, and the supplying of the rolling oil is able to be individually performed for each of the selected rolling stands.

8. The rolling method according to claim 2, wherein the selected rolling stands are two or more rolling stands, and the supplying of the rolling oil is able to be individually performed for each of the selected rolling stands.

9. The rolling method according to claim 1, wherein the selected rolling stands include a final rolling stand, and in the supplying of the rolling oil to the final rolling stand, a mixing ratio of the rolling oil of the first rolling oil supply system to the rolling oil of the second rolling oil supply system is controlled based on a friction coefficient at the final rolling stand and a friction coefficient at an upstream stand, the upstream stand being a rolling stand located upstream of the final rolling stand.

10. The rolling method according to claim 2, wherein the selected rolling stands include a final rolling stand, and in the supplying of the rolling oil to the final rolling stand, a mixing ratio of the rolling oil of the first rolling oil supply system to the rolling oil of the second rolling oil supply system is controlled based on a friction coefficient at the final rolling stand and a friction coefficient at an upstream stand, the upstream stand being a rolling stand located upstream of the final rolling stand.

11. The rolling method according to claim 3, wherein the selected rolling stands include a final rolling stand, and in the supplying of the rolling oil to the final rolling stand, a mixing ratio of the rolling oil of the first rolling oil supply system to the rolling oil of the second rolling oil supply system is controlled based on a friction coefficient at the final rolling stand and a friction coefficient at an upstream stand, the upstream stand being a rolling stand located upstream of the final rolling stand.

12. The rolling method according to claim 7, wherein the selected rolling stands include a final rolling stand, and in the supplying of the rolling oil to the final rolling stand, a mixing ratio of the rolling oil of the first rolling oil supply system to the rolling oil of the second rolling oil supply system is controlled based on a friction coefficient at the final rolling stand and a friction coefficient at an upstream stand, the upstream stand being a rolling stand located upstream of the final rolling stand.

13. The rolling method according to claim 8, wherein the selected rolling stands include a final rolling stand, and in the supplying of the rolling oil to the final rolling stand, a mixing ratio of the rolling oil of the first rolling oil supply system to the rolling oil of the second rolling oil supply system is controlled based on a friction coefficient at the final rolling stand and a friction coefficient at an upstream stand, the upstream stand being a rolling stand located upstream of the final rolling stand.

14. A rolling device comprising:

a tandem rolling mill including a plurality of rolling stands;

a first rolling oil supply system configured to circulate and supply rolling oil after a removal treatment of wear powder generated by rolling;

a second rolling oil supply system configured to supply rolling oil containing the wear powder generated by rolling;

a mixing unit configured to mix the rolling oil supplied from the first rolling oil supply system and the rolling oil supplied from the second rolling oil supply system to obtain mixed rolling oil, a first storage tank to store rolling oil collected from the plurality of rolling stands, a second storage tank to store rolling oil after performing the removal treatment of the wear powder generated by rolling, and a wear powder removing device to perform a removal treatment of the wear powder on rolling oil in a first storage tank and to supply rolling oil in the first storage tank to a second storage tank, wherein the first rolling oil supply system includes a first rolling oil pipeline configured to supply the rolling oil in the second storage tank to the mixing unit, the second rolling oil supply system includes a second rolling oil pipeline configured to supply the rolling oil in the first storage tank to the mixing unit, and the mixed rolling oil is supplied to a rolling stand selected from the plurality of rolling stands.

15. The rolling device according to claim 14, further comprising:

a storage tank to which a neat oil of rolling oil is replenished is interposed downstream of an interposition location of the wear powder removing device in the first rolling oil pipeline.

16. The rolling device according to claim 14, wherein the selected rolling stands are two or more rolling stands, and the mixing unit is individually provided for each rolling stand to which the rolling oil is supplied.

17. The rolling device according to claim 14, wherein the selected rolling stand includes a final rolling stand, the rolling device further comprises:

a mixing ratio control unit configured to obtain a mixing ratio of the rolling oil of the first rolling oil supply system to the rolling oil of the second rolling oil supply system in the mixed rolling oil supplied to the final rolling stand based on a friction coefficient at the final rolling stand and a friction coefficient at an upstream stand, the upstream stand being a rolling stand located upstream of the final rolling stand, and the rolling oil of the first rolling oil supply system and the rolling oil of the second rolling oil supply system are mixed in the mixing unit to have the mixing ratio supplied from the mixing ratio control unit.

18. The rolling device according to claim 17, further comprising:

a first friction coefficient computing unit configured to obtain the friction coefficient at the upstream stand; and a target friction coefficient setting unit configured to set a target friction coefficient at the final rolling stand such that an absolute value of a difference between the friction coefficient at the final rolling stand and the friction coefficient at the upstream stand is 0 or more and 0.01 or less, wherein the mixing ratio control unit controls the mixing ratio of the mixed rolling oil supplied to the final rolling stand such that the friction coefficient at the final rolling stand is the target friction coefficient set by the target friction coefficient setting unit.

* * * * *